United States Patent [19]

Kuroda et al.

[11] Patent Number: 4,505,983

[45] Date of Patent: Mar. 19, 1985

[54] HEAT-SENSITIVE TRANSFER SHEETS

[75] Inventors: Koji Kuroda; Hideichiro Takeda, both of Tokyo, Japan

[73] Assignee: Dai Nippon Insatsu Kabushiki Kaisha, Tokyo, Japan

[21] Appl. No.: 493,947

[22] Filed: May 12, 1983

[30] Foreign Application Priority Data

May 17, 1982 [JP] Japan ..... 57-82855

[51] Int. Cl.[3] ..... B41M 5/26

[52] U.S. Cl. ..... 428/423.1; 346/214; 428/207; 428/211; 428/423.7; 428/425.1; 428/488.1; 428/913; 428/914

[58] Field of Search ..... 282/27.5; 427/150–153; 428/320.4–320.8, 411, 488, 537, 913, 914, 195, 207, 211, 411.1, 423.1, 423.7, 425.1, 488.1, 537.5; 346/214

[56] References Cited

FOREIGN PATENT DOCUMENTS

| | | | |
|---|---|---|---|
| 0064306 | 5/1977 | Japan | 346/214 |
| 0017740 | 2/1979 | Japan | 346/214 |
| 0079192 | 6/1980 | Japan | 346/214 |
| 0159993 | 12/1980 | Japan | 346/214 |
| 6099695 | 8/1981 | Japan | 346/209 |
| 6169087 | 12/1981 | Japan | 346/209 |
| 0064592 | 4/1982 | Japan | 346/209 |
| 2028526A | 3/1980 | United Kingdom | 346/214 |

*Primary Examiner*—Bruce H. Hess

*Attorney, Agent, or Firm*—Parkhurst & Oliff

[57] ABSTRACT

A heat-sensitive transfer sheet comprising a substrate and a transfer layer formed on one surface of the substrate, wherein the transfer layer contains a coloring agent and, a compound having at least one atomic group —NHCO— in each molecule as a binder.

4 Claims, No Drawings

HEAT-SENSITIVE TRANSFER SHEETS

BACKGROUND OF THE INVENTION

This invention relates to a heat-sensitive transfer sheet which exhibits excellent thermal transferability and which can provide sharp printing on paper to be transfer printed.

In recent years, heat-sensitive transfer recording processes wherein a thermal head is used have been widely used because such processes are advantageous in that they produce no noise, the apparatus therefor is relatively inexpensive and compact, and maintenance is easy. As a heat-sensitive transfer sheet used in such heat-sensitive recording processes, there have been proposed heat-sensitive transfer sheets each having a transfer layer which is obtained by applying a composition onto one surface of a substrate having excellent thermal conductivity and heat resistance such as capacitor paper, polyester films and the like wherein the composition is obtained by melting and incorporating a coloring agent into waxes such as natural wax, synthetic wax and the like as a binder.

Generally speaking, performance characteristics required for the heat-sensitive recording binder include the property of preventing dark reaction prior to use; resistances such as wear resistance, deflection resistance, heat resistance, cold resistance, and chemical resistance; melting characteristic during heat printing; prevention of unnecessary color development through heat transmission to the non-image area; and the like. Binders which meet these requirements to some extent and which are being currently used include waxes such as paraffin wax, microcrystalline wax, polyethylene wax, beeswax, white Japan wax, carnauba wax, montan wax, ceresin wax, castor wax, and the like; stearic acid and derivatives thereof such as stearic acid amide, metal stearate and the like; and higher fatty acid amides and the like.

However, even if these waxes which have been predominatly used in the transfer layer in the prior art as the binder are a single material, practically, such waxes comprise a mixture of compounds having different molecular weights. When such a wax is heated, the melting point range from an initial point wherein the wax starts to melt to an end point wherein the wax is completely molten is broad, i.e., from 5° to 10° C. Accordingly, the temperature of the thermal head may give rise to insufficient transfer, or it may be impossible to avoid bleeding of the printing resulting from the melting of the compounds having relatively low melting point which is present in the transfer layer near the printed portions. Therefore it is difficult to transfer a sharply outlined character or figure.

When natural wax is used, the composition may vary, depending upon the place of production and weather conditions, and therefore it is difficult to produce products of constant quality. Furthermore, damage easily occurs because the wax is soft at room temperature.

SUMMARY OF THE INVENTION

In view of the difficulties of the prior art as described above, studies have been carried out directed toward overcoming these difficulties. As a result, it has been found that the prior art problems can be overcome by using a heat-sensitive transfer sheet which is manufactured by using a reaction product of a compound having at least one isocyanate group with a compound having an active hydrogen as a binder because such a product is solid at room temperature and has a distinct melting point with a narrow temperature range. The present invention is based on this discovery.

An object of the present invention is to provide a heat-sensitive transfer sheet wherein: distinct transfer recording can be carried out without any bleeding; migration during storage does not readily occur; and hardness is high at room temperature, whereby damage does not readily occur.

The present invention relates to a heat-sensitive transfer sheet having a transfer layer formed on one surface of a substrate, the transfer layer containing a coloring agent present in a binder which melts upon being heated, characterized in that a compound containing at least one atomic group —NHCO— in each molecule is used as the binder.

DETAILED DESCRIPTION OF THE INVENTION

Substrate

Any of the substrates used as substrates of conventional heat-sensitive transfer sheets can be used as the substrate of the heat-sensitive transfer sheet of the present invention. Examples of such substrates are films of plastics such as polyester resin, polypropylene resin, cellophane, cellulose triacetate resin, polystyrene resin, polycarbonate resin, and polyimide resin; papers such as glassine paper, capacitor paper, ledger paper, and India paper; metal foils; and composites of said materials.

Composites suitable for use herein include aluminum/paper composite, metal deposited paper, metal deposited plastic films, and the like. The substrate is made as thin as possible from the standpoint of thermal conductivity, the thickness ordinarily being from 2 to 50 μm, preferably from 4 to 20 μm. When the thickness is less than 2 μm, the strength of the substrate is insufficient, and its handling is difficult. When the thickness is more than 50 μm, the resolving power of printed images and of characters is decreased, and thus such thickness is not desirable in practice.

A slip agent such as silicone oil may be applied to one side of the above mentioned substrate, i.e., the side which contacts the thermal head in the use of the heat-sensitive transfer sheet in order to impart slip property. A heat-resistant resin layer may be formed on that surface to prevent adhesion of the substrate to the thermal head in use (so-called "sticking"). Alternatively, lubricants such as talc and fluorine-base resin powder may be further added to the synthetic resin layer to prevent the sticking in a similar manner.

Coloring Agent

Among organic or inorganic dyes or pigments, good coloring agents are those having suitable characteristics as recording materials. For example, preferred coloring agents are those which have sufficient color density and which do not undergo discoloration or fading by light, heat, humidity and the like.

Alternatively, it is possible to use such materials as those which are colorless when not being heated but develop color upon being heated or those which develop colors upon contacting substances which have been applied onto the material to be transfer printed.

Binders

Binders which can be used in the present invention are compounds having at least one atomic group —NH-CO— such as urea, urethane, thiourethane, carbamic carboxylic acid anhydride and acid amide linkages in each molecule. Examples of such binders which can be used in the present invention are compounds represented by the following formulae:

$R(NHCO)R'$
$R(NHCO)OR'$ or $R(NHCO)SR'$
$R(NHCO)OOR'$
$R(NHCO)NH_2$
$R(NHCO)NHR'$
$R(NHCO)NR'_2$
$R(NHCO)ONR'_2$
$R(NHCO)ONCR'_2$
$R(NHCO)NHOH$
$R(NHCO)N(COR')_2$
$R(NHCO)NHR'SO_3Na$
$R(NHCO)NHSO_2Ar$
$R(NHCO)(NHCO)NHR'$
$R(NHCO)(NHCO)NH_2$
$R(NHCO)(NHCO)NR'_2$
$R(NHCO)NHNH(CONH)R'$
$R(NHCO)Cl$
$R(NHCO)Br$
$R(NHCO)CN$
$R(NHCO)SO_3Na$
$R(NHCO)CH(COOR')_2$
$R(NHCO)CH(COCH_3)COOR'$

While these compounds are examples of those having one atomic group —NHCO— in each molecule, the binder may have two or more groups such as urea, urethane, thiourethane, and carbamic carboxylic acid anhydride and acid amide linkages.

In the foregoing formulae, R and R' are alkyl or aryl groups. For example, these groups are alkyl groups containing from 1 to 22 carbon atoms such as methyl, ethyl, propyl, butyl, amyl, hexyl, octyl, decyl, tetradecyl, heptadecyl, docosyl and the like, or aryl groups such as phenyl, tolyl, xylyl, and naphthyl.

The above mentioned compounds have melting points of from 50° to 200° C. and melting point ranges which are narrow, i.e., from 0.1° to 4.5° C. The compounds have a melt viscosity of from 10 to 3,000 centipoises. Since these compounds can be generally dispersed or dissolved in a solvent to decrease the viscosity to from 1 to 2,000 centipoises, the composition containing these compounds, a coloring agent and additives incorporated in the solvent can also be applied by a cold application process such as gravure coating or silk screen printing process other than the hot melt coating process.

Each compound as described hereinabove can be obtained by reacting a known compound having one or more isocyanate groups with a known compound having an active hydrogen atom.

The compounds having one or more isocyanate groups which can be used in the present invention are a variety of isocyanates including monoisocyanates such as methyl isocyanate, ethyl isocyanate, n-propyl isocyanate, n-butyl isocyanate, octadecyl isocyanate, and polymethylenepolyphenylisocyanate; diisocyanates such as 2,4-tolylenediisocyanate, 4,4'-diphenylmethanediisocyanate, dianisidinediisocyanate, meta-xylylenediisocyanate, 1,5-naphthalenediisocyanate, trans-vinylenediisocyanate, N,N'-(4,4'-dimethyl-3,3'-diphenyldiisocyanate) uredione, and 2,6-diisocyanatemethylcaproate; and triisocyanates such as triphenylmethanetriisocyanate, and tris(4-phenylisocyanatethiophosphate) 4,4',4''-trimethyl-3,3',3''-triisocyanate-2,4,6-triphenylcyanurate. Other compounds which can be utilized in the present invention are a variety of diisocyanates which are industrially prepared and marketed, such as, for example, ethylene-, tetramethylene-, hexamethylene-, heptamethylene-, octamethylene-, decamethylene-, p-phenylene-, m-phenylene-, m-toluylene-, naphthalene-1,5-, di(p-isocyanil-cyclohexyl) methane-, and tri(p-isocyanilphenyl) methane-diisocyanates.

The compounds having active hydrogen which can be used in the present invention are those having atomic groups such as —OH, —$NH_2$, —SH, —COOH, as well as hydrogen peroxide, hydrogen chloride, hydrogen bromide and prussic acid. Examples of compounds having such atomic groups are alcohols wherein —OH is attached to an alkyl, cyclic alkyl or benzyl group containing from 1 to 30 carbon atoms; carboxylic acids containing from 1 to 30 carbon atoms such as formic acid, acetic acid, butyric acid, valeric acid, caprylic acid, and palmitic acid; ammonia; amines containing from 1 to 30 carbon atoms such as ethylamine, propylamine, butylamine, amylamine, and aniline; thiols containing from 1 to 30 carbon atoms such as ethyl mercaptan, propyl mercaptan, butyl mercaptan, amyl mercaptan, hexyl mercaptan, heptyl mercaptan, octyl mercaptan, and decyl mercaptan.

The reactions of the above mentioned compound having at least one isocyanate group and the above-mentioned compound having an active hydrogen are known. For example, such reactions proceed as follows:

$$RNCO + R'NH_2 \rightarrow RNHCONHR'$$

$$RNCO + R'OH \rightarrow RNHCOOR'$$

$$RNCO + R'SH \rightarrow RNHCOSR'$$

$$RNCO + R'COOH \rightarrow RNHCOOCOR' \rightarrow RNHCOR'$$

In order to accelerate these reactions, a catalyst may be used.

These compounds (reaction products) have melting points as described hereinbefore, in which the melting point ranges are narrow. Further, these compounds have high hardnesses at room temperature and have excellent retention of the coloring agent. Accordingly, even if the heat-sensitive transfer sheets obtained by using these compounds are stacked, these compounds will not migrate to the member which is in contact with the adjacent heat-sensitive transfer sheet, in this case to the substrate surface of the heat-sensitive transfer sheet which is below. That is, transfer of the coloring agent which occurs spontaneously can be inhibited. Further, the transfer layer has excellent wear resistance.

The reasons why the above described compound is preferred as the binder for the transfer layer of the heat-sensitive transfer sheet are as follows.

Each of these compounds is a single compound rather than a mixture of various compounds, whereas wax and the like comprise such mixtures. Therefore, these compounds have sharp melting points exhibiting extremely narrow temperature ranges. The above mentioned compounds have the atomic group —NHCO in each molecule. It is likely that in adjacent molecules, there occurs attraction between both dipoles, i.e., between N—H and C—O, and thus the compound has a high melting point even if the molecular weight is relatively small. Further, a strong film can be formed in a solid state.

The melting point of the above mentioned compound is restricted to from 50° to 200° C. for the following reasons. When the melting point is less than 50° C., the compound having such a melting point is not preferred as the binder for the transfer layer of the heat-sensitive transfer sheet because of migration during storage and blocking. When the melting point is more than 200° C., it is necessary to impart excessive energy to the thermal head during heat transfer printing, and the thermal head may be damaged or broken or the serviceable life of the thermal head may be significantly decreased. Further, in the latter case the heat-sensitive transfer sheet may be torn, and a sticking or similar phenomenon may take place when the substrate is a plastic film.

The processes for producing the heat-sensitive transfer sheet using the substrate the coloring agent and the binder as described above will now be described.

The coloring agent and the binder are kneaded to prepare a composition which is then applied to one surface of the substrate by any suitable application method. The composition is prepared by mixing the coloring agent with the binder so that the coloring agent will be present at a level of from 1 to 80% and preferably from 2 to 20% of total amount of these components, if necessary adding optional components to the mixture, and then kneading the resulting mixture at room temperature or an elevated temperature.

Examples of the optional components are: softening agents such as mineral oil and vegetable oil; agents for improving thermal conductivity such as metallic powder; fillers such as micro silica, calcium carbonate, and kaolin; agents for improving transferability such as polyhydric alcohols; and solvents or diluents. The solvents or diluents are used in preparing an ink composition for conventional printing processes. Examples of such solvents or diluents are xylene, toluene, trichlene, white spirit, ethyl acetate, n-butyl acetate, methanol, ethanol, isopropanol, n-butanol, ethylcyclohexane, ethyl cellosolve, butyl cellosolve, and cychlohexanone.

Examples of processes suitable for applying the thus prepared composition onto one surface of the substrate are: processes wherein hot melt coating compositions, etc. are heated and melted and then applied; conventional application processes such as gravure coating, roll coating, air-knife coating, lick roller coating, spray coating, spread coating, dip coating, spinner coating, whirler coating, brushing, solid coating by silk screen, wire bar coating and flow coating; and printing processes such as gravure printing, gravure-offset printing, lithography-offset printing, dilitho printing, copperplate printing, and silk screen printing.

The thickness of the transfer layer thus formed is from 0.1 μm to 30 μm, and is preferably from 1 μm to 20 μm. When the thickness is less than 0.1 μm, the density of the printing is insufficient, and therefore such thickness is unsuitable for the purposes of the recording. When the thickness of the transfer layer is more than 30 μm, the thermal conductivity becomes inferior, and therefore good transfer printing cannot be carried out.

In the heat-sensitive transfer sheet of the present invention, the compound having at least one atomic group (NHCO— in each molecule is used as the binder, and therefore clear transfer recording can be carried out without any bleeding. Further, migration does not readily occur during storage. Furthermore, almost no damage occurs because the hardness is high at room temperature.

The following examples are set forth as illustrations of the invention and are not intended to limit the scope thereof.

EXAMPLE 1

Ethyl cellosolve was mixed with 2,6-toluenediisocyanate in such a proportion that the molar ratio of —OH to —NCO contained in each molecule was 1:1, and dibutyl tin laurate was added to the mixture as a catalyst in an amount of 0.01% by weight of the total amount of the mixture. The reaction mixture was maintained for 5 hours at a temperature of 100° C. with continuous stirring to react the compounds. Thereafter, the reaction mixture was cooled, and the reaction product was collected. When the peak at about 2,300 $cm^{-1}$ was checked by means of an infrared spectrophotometer to determine the presence of a —NCO group, absorption at about 2,300 $cm^{-1}$ was not observed, and thus it was confirmed that no —NCO group was present in the reaction product. The melting point of the reaction product was from 135° to 140° C.

A composition for hot melt coating was prepared by kneading the reaction product thus obtained and other components as enumerated below in the stated proportions in a ball mill for 12 hours with heating at a temperature of 100° C.

| Composition | % by weight |
|---|---|
| reaction product | 50 |
| toluene | 36 |
| carbon black | 10 |
| softening agent manufactured by Idemitsu Sekiyu, Japan and marketed under the tradename CS-55 | 2 |
| polyethylene glycol (mean molecular weight of 400) | 2 |

The composition thus obtained was applied onto a polyester film having a thickness of 6 μm by a wire bar coating process so that the coating thickness was 2 μm while the film mounted on a hot plate was heated to a temperature of 170° C., whereby a transfer sheet was formed.

The composition-bearing surface of this transfer sheet and wood-free or pure paper having a basis weight of 50 grams per square meter were laminated. Printing was carried out by using a thermal printer (manufactured by Shinko Denki, Japan, and marketed under the tradename SP-3080) to obtain black sharp printing on the pure paper surface.

EXAMPLE 2

Hexamethylenediisocyanate was mixed with ethyl alcohol so that the —NCO and —OH groups contained in each molecule were present in equimolar amounts the mixture was heated for 10 hours at a temperature of 80° C. with stirring to cause a reaction. The melting point of the resulting product was from 83° C. to 86° C. The presence of the —NCO group was not observed under examination by means of an infrared spectrophotometer.

This product and the following other components were stirred in a ball mill at room temperature to prepare a gravure ink composition having a viscosity of 300 centipoises at a temperature of 25° C.

| Gravure Ink Composition | |
|---|---|
| | % by weight |
| product | 30 |
| red dye (C.I. 15850) | 3 |
| ethyl alcohol | 50 |
| isopropyl alcohol | 17 |

The resulting gravure ink composition was applied onto capacitor paper having a thickness of 10 μm by a gravure coating process to a thickness of the film (dry basis) of 3 μm, whereby a transfer paper was obtained. When the printing was carried out with the use of a printing machine equipped with a thermal head (manufactured by Toshiba, Japan, and marketed under the tradename of F1610), sharply outlined red printing was achieved.

EXAMPLE 3

Example 2 was repeated except that yellow dye (C.I.21090), indigo blue dye (C.I.74160) and carbon black were used as the coloring agent to prepare yellow ink, indigo blue ink and black ink, respectively.

Each of these inks and the red ink obtained in Example 2 were applied onto capacitor paper of a thickness of 10 μm to form yellow, red, indigo blue and black regions sequentially aligned in the printing direction.

The transfer sheet thus prepared and the thermal head used in Example 1 were used. First, the desired yellow printing was carried out while the yellow region was fed to paper. The paper was then returned to the starting position of the yellow printing, and the red region of the transfer paper was used to carry out the desired red printing. The indigo blue printing and black printing were carried out in the same manner, and thus printing classified by four colors was achieved.

What is claimed is:

1. A heat-sensitive transfer sheet comprising:

(a) a substrate; and (b) a transfer layer formed on a surface of said substrate, said transfer layer containing a coloring agent and a binder, said binder melting upon heating;

wherein said binder comprises a compound having at least one —(NHCO)— group in each molecule, said binder compound comprising the reaction product of a compound selected from the group consisting of isocyanates, diisocyanates and triisocyanates and a compound having an active hydrogen atom, said binder compound having a melting point of from 50° C. to 200° C.

2. The heat-sensitive transfer sheet of claim 1, wherein said binder compound comprises the reaction product of a compound selected from the group consisting of diisocyanates and triisocyantes and a compound selected from the group consisting of alkyl alcohols and aryl alcohols.

3. The heat-sensitive transfer sheet of claim 1, wherein said binder compound having a melting point of from 50° C. to 200° C. has a narrow melting range of from 0.1° C. to 4.5° C.

4. The heat-sensitive transfer sheet of claim 1, wherein said binder compound comprises the reaction product of a compound selected from the group consisting of methyl isocyanate, ethyl isocyanate, n-propyl isocyanate, n-butyl isocyanate, octadecyl isocyanate, polymethylene-polyphenylisocyanate, 2,4-tolylenediisocyanate, 4,4'-diphenylmethanediisocyanate, dianisidinediisocyanate, meta-xylylenediisocyanate, 1,5-naphthalenediisocyanate, trans-vinylenediisocyanate, N,N'-(4,4'-dimethyl-3,3'-diphenyldiisocyanate)uredione, 2,6-diisocyanatemethylcaproate, triphenylmethanetriisocyanate, tris(4-phenylisocyanatethiophosphate)4,4',4''-trimethyl-3,3',3''-triisocyanate-2,4,6-triphenylcyanurate, ethylene diisocyanate, tetramethylene diisocyanate, hexamethylene diisocyanate, heptamethylene diisocyanate, octamethylene diisocyanate, decamethylene diisocyanate, p-phenylene diisocyanate, m-phenylene diisocyanate, m-toluylene diisocyanate, naphthalene-1,5 diisocyanate, di(p-isocyanil-cyclohexyl)methane diisocyanate, and tri(p-isocyanilphenyl)methane-diisocyanate and a compound selected from the group consisting of alkyl alcohols having from 1 to 30 carbon atoms, cyclic alkyl alcohols having from 1 to 30 carbon atoms, benzyl alcohols having from 1 to 30 carbon atoms, carboxylic acids having from 1 to 30 carbon atoms, ammonia, amines having from 1 to 30 carbon atoms and thiols having from 1 to 30 carbon atoms.

* * * * *